United States Patent [19]

Nameny

[11] Patent Number: 4,464,995

[45] Date of Patent: Aug. 14, 1984

[54] METHOD AND APPARATUS FOR REMOVING RAILWAY TIES

[75] Inventor: Frank J. Nameny, Minnetonka, Minn.

[73] Assignee: Loram Maintenance of Way, Inc., Hamel, Minn.

[21] Appl. No.: 277,835

[22] Filed: Jun. 26, 1981

Related U.S. Application Data

[63] Continuation-in-part of Ser. No. 13,983, Feb. 22, 1979, abandoned.

[51] Int. Cl.[3] ..... E01B 29/06

[52] U.S. Cl. ..... 104/9; 254/43

[58] Field of Search ..... 104/6, 9, 10, 12; 254/43, 44; 37/104

[56] References Cited

U.S. PATENT DOCUMENTS

| | | | |
|---|---|---|---|
| 539,755 | 5/1895 | LaDow | 172/765 |
| 1,231,679 | 7/1917 | Weiss | 104/12 |
| 2,986,100 | 5/1961 | Kershaw | 104/12 |
| 3,496,883 | 2/1970 | Bodine | 104/9 |
| 3,618,670 | 11/1971 | Alberto | 172/118 |
| 3,948,185 | 4/1976 | Settle et al. | 104/9 |

*Primary Examiner*—Robert B. Reeves
*Assistant Examiner*—Gregory A. Beehner
*Attorney, Agent, or Firm*—Peterson, Palmatier, Sturm, Sjoquist & Baker, Ltd.

[57] ABSTRACT

A method and apparatus for removing defective railroad ties from the right-of-way in one piece and without disturbing the elevation, cross-level and line, of a track system. The method is carried out by first removing the tie plates from an individual tie to be replaced; forming a trench underneath the tie by the use of laterally directed scarifiers while retaining the tie in its normal position and restraining the tie against movement longitudinally of the track system so as to displace ballast material from underneath the tie to the next adjacent crib; applying a downward force to the top of the tie to be removed; and withdrawing the tie from one or the other end. The apparatus for performing the method includes a plurality of laterally spaced-apart scarifier means adapted to be rotated about a common axis that is parallel to the longitudinal axis of a tie to be removed; a restraining means to retain the tie in its normal position while the scarifiers are rotated down and through the ballast underneath the tie to thereby "pump" the ballast material from a chamber, the top of which is defined by the lower surface of the tie; a means for providing a downwardly directed force on the top of the tie to displace it downwardly underneath the rails of the track system; and a means for withdrawing the tie from either end.

10 Claims, 23 Drawing Figures

40
45
41
64
44
53
62
66
79
73
52
80
81A
82
83
84

METHOD AND APPARATUS FOR REMOVING RAILWAY TIES

This is a continuation-in-part of application Ser. No. 13,983, filed Feb. 22, 1979, now abandoned.

BACKGROUND OF THE INVENTION

1. Field of the Invention

This invention relates to improvements in a method and apparatus for removing individual railway ties from a railroad track system without disturbing adjacent or other components of the system. The method and apparatus accomplish the desired end of removing a complete tie with a minimum of disturbance to the right-of-way, the track line or the ballast adjacent the tie as well as allowing removal of the tie from either end with a minimum side clearance requirement.

2. Description of the Prior Art

Typical examples of prior art may be seen in U.S. Pat. Nos. 3,496,883, 3,881,422, 3,948,185 and 4,047,280. On one hand, these patents illustrate a system that requires the actual cutting away of the wood on the top part of a tie so that it may be withdrawn from one side or the other or, on the other hand, illustrate the use of a vibratory element to displace, by compaction, material from or under a tie to allow the tie to drop down underneath the rails so that it may be withdrawn from either side. The difficulty with the brute force cutting concept ought be readily apparent to those skilled in the art and is believed to have fallen into disuse by the industry with which my invention is concerned. The use of a vibratory force either to displace ballast to one side or in a downward direction is also believed to be incongruent with the principles of ballast beds for railway track systems. The use of the vibratory technique tends to compact the ballast in the very area in which it is desired to maintain the proper ballast density or distribution and relationship. Further, where a vibrating probe is to be inserted completely under the length of a tie to be removed, the difficulties of working between adjacent railway lines and on narrow right-of-ways is believed to be readily apparent as well as the clear, inherent difficulties of physically moving a vibrating probe completely underneath a tie to displace ballast with a V-shaped tip.

SUMMARY OF THE INVENTION

The method and apparatus of my invention permits a fast and efficient mode of operation to accomplish the longstanding problem of removing defective ties from a railway track system in such a manner that there will be a minimum effect on the condition of the ballast surrounding the defective tie and the other components of a railroad right-of-way system. My method and apparatus further provides a dramatic increase in the efficiency and speed of operation for the removal of defective ties.

The method of my invention may be carried out by engaging the top and one side edge of a defective tie while it is in position in a railway track system and then applying appropriately disposed and configured rotatable scarifying means downwardly and underneath a tie in a direction toward the side restraining means to provide a "shearing" and "pumping" action to displace ballast from underneath the tie in a direction lateral to the longitudinal axis of the tie and without any further compaction of the ballast material, into a crib adjacent the tie, and then exerting a downward force to place the tie in a lowered position underneath the level of the bottom of the rails of the track system and removing the tie by gripping either end and withdrawing the tie laterally of the railroad track system with a sweeping motion.

The apparatus for performing the method of my invention consists of a vertically moveable work head that extends across the width of a railway track system from which defective ties are to be removed and which includes a plurality of downwardly extending tie engaging and restraining portions at one side of the lower end and a plurality of rotatable scarifying means along the other side of the lower end and an intermediate lower portion that may rest upon the top surface of a tie to be removed. The work head is disposed for vertical reciprocation on a moveable vehicle and may be lowered as the vehicle is moving so that the tie engaging and restraining members may ride up against the side of a tie to be removed to effect a straightening operation in the case of skewed ties, at which point the vehicle is stopped and the scarifying means, each provided with a configuration that will coact with the ballast underneath the tie and the lower surface of the tie, when rotated, to "pump" ballast out from underneath the tie to allow the tie to be lowered when a suitable downward force is applied through the work head. Articulated tie withdrawing booms, having suitable tie gripping means, are provided for withdrawing the lowered tie from either end and are designed to be operated with a sweeping action for minimum side extension when a tie is withdrawn.

In one illustrated embodiment of my invention, the method and apparatus contemplate the removal of laterally spaced "pockets" of ballast material from underneath the tie by the use of the laterally rotatable scarifying implements spaced at appropriate locations along the length of a tie.

In a second embodiment of my invention, the laterally rotatable ballast "pumping" scarifier implements are adjustably moveably disposed on the bottom of the work head for movement longitudinally of the tie to provide for the removal of ballast material from underneath the entire length of the tie to be removed.

The scarifier implements may also be configured to distribute "shearing" type displacement forces on the ballast to be removed upon insertion underneath a tie and to withdraw ballast in the opposite direction upon withdrawal from underneath a tie. In either case, a non-compacting removal of the ballast is effected.

These and other advantages and objects of my invention will become apparent from a consideration of the appended specification, claims and drawings.

BRIEF DESCRIPTION OF THE DRAWINGS

FIGS. 9, 10, 11 and 12 are further enlarged fragmentary views of portions of the apparatus of FIGS. 1 and 2, showing the operation thereof;

FIGS. 20 and 21 are enlarged fragmentary front elevational views of a portion of the apparatus of FIG. 15 shown in two different positions of operation.

DESCRIPTION OF THE FIRST ILLUSTRATED EMBODIMENT

Figure 1:
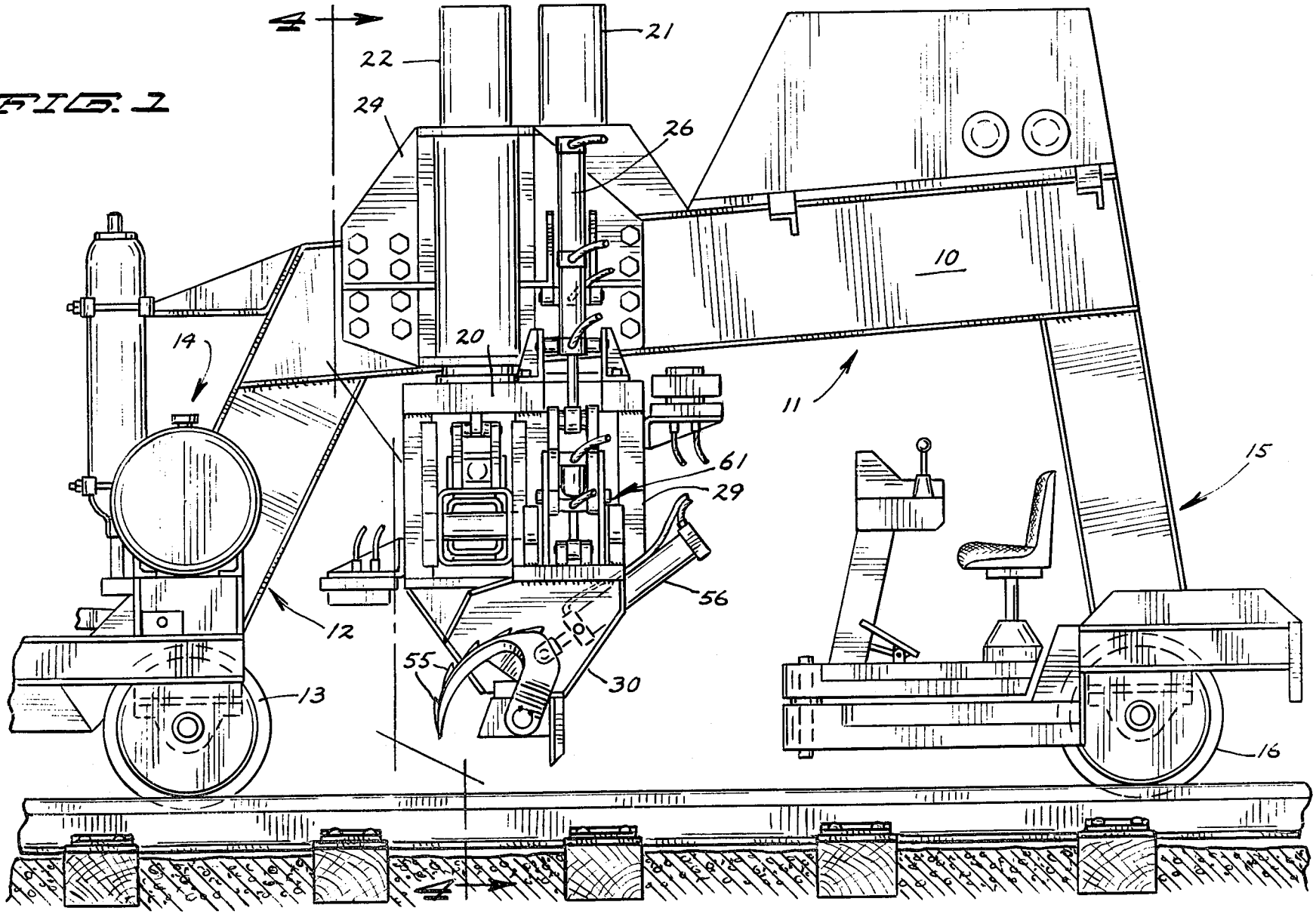
FIGS. 1 and 2 are side elevational views of one embodiment of my invention illustrating the tie removing mechanism in two phases of operation.

Referring now to FIGS. 1–14 of the drawings, and particularly to FIGS. 1, 2, 3 and 5, there is shown a tie extracting apparatus indicated generally by reference character 10. Apparatus 10 may be used to practice my method of removing defective ties from a track system comprised of rails 84, ties 80, bearing plates 81, rail anchors 82 and spikes 83.

Tie extracting apparatus 10 includes a generally longitudinally extending main frame 11 that is supported at its forward end, 12, by a railroad truck, 13 and includes a source of power, 14, for propulsion and operation of the various elements of my invention, and is supported at its rear end, 15, by a railroad truck 16. An operator's console, 17, is shown pivotally disposed on a pivot pin 18 for the convenience of an operator in operating the apparatus from one side or the other.

Figure 2:
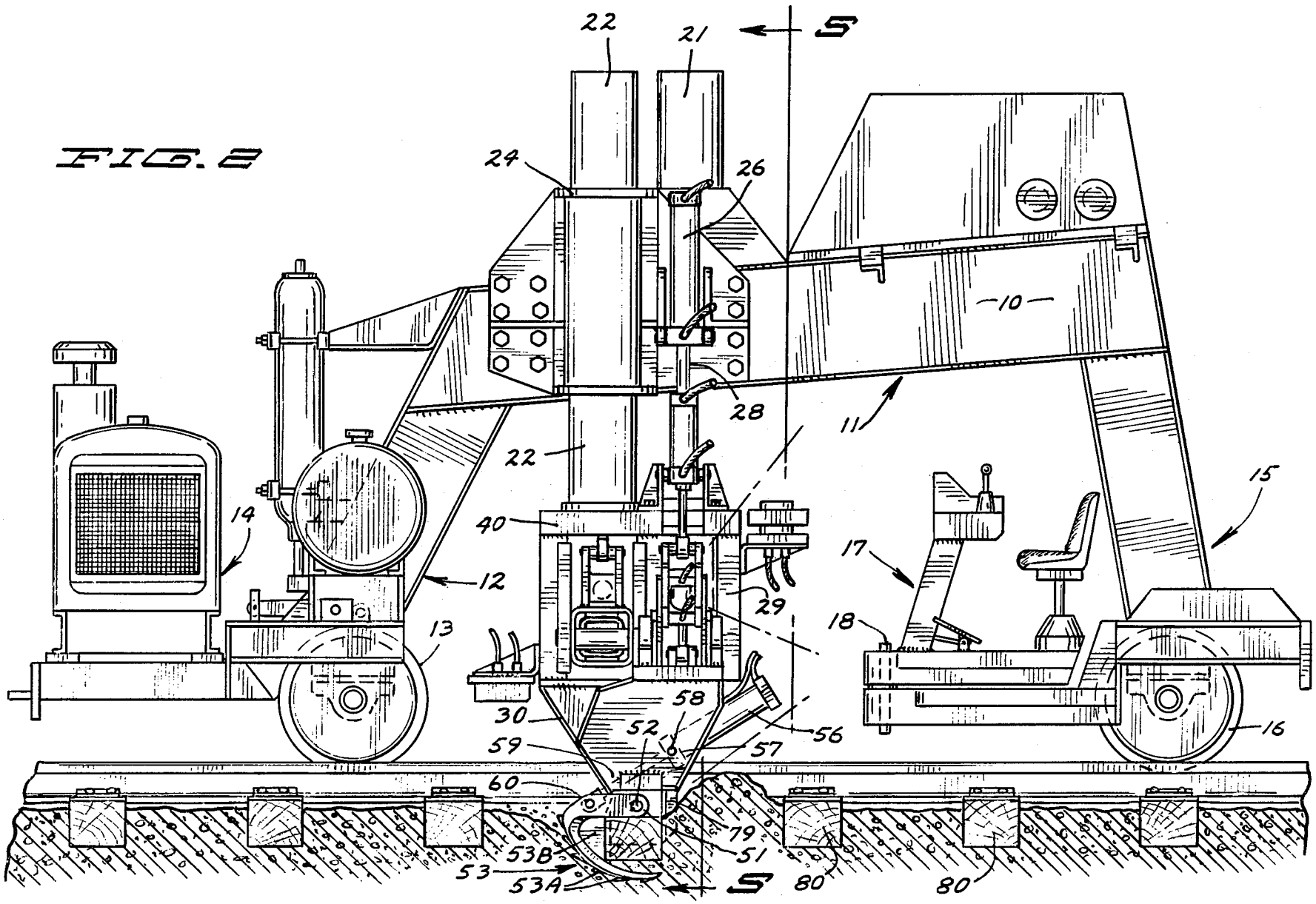
Figure 5:
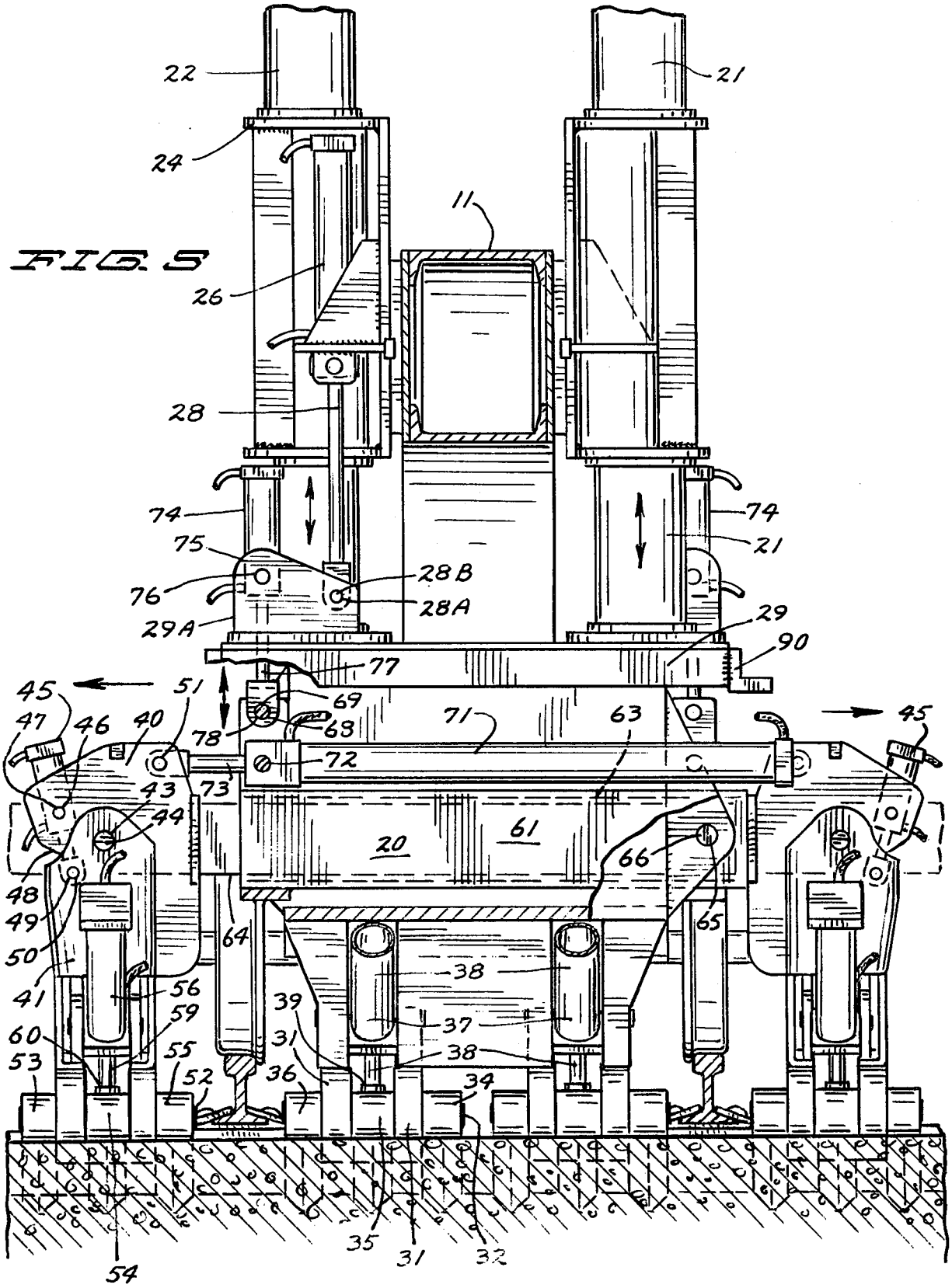
FIG. 5 is an enlarged sectional view taken along section line 5—5 on FIG. 2.

At this point, it may be noted that for all essential factors, the apparatus of my invention is substantially symmetrical about its longitudinal axis and reference characters are applied to elements lying basically on the left side of FIG. 5 as well as those shown in elevation on FIGS. 1 and 2.

A work head 20, having a truss frame 29, is shown suspended from vertically disposed tubes 21 and 22 that are journaled for vertical reciprocal movement in similarly configured linear motion journal bearings 23 and 24 mounted on the horizontal portion of main frame 11. It may be seen that work head 20 and all apparatus carried thereby may therefore be adjustably disposed in a vertical direction to accomplish the several functions to be described below. The positioning of work head 20 is accomplished by the conjoint operation of hydraulic cylinders 25 and 26, having piston rod members 27 and 28 respectively, connected to suitable upwardly extending connecting members 29A on the top of frame 29. Piston rod 28 is shown connected to member 29A through pin 28 disposed in hole 28A. The relative disposition and location of the corresponding connections from frame 29 to cylinder 25 are not shown in full outline as their location and configuration may reasonably be determined by one skilled in the art to which this invention pertains.

Three ripper teeth elements 34, 35 and 36 are non-rotatably disposed on shaft 32 by suitable keys (not shown) or the like, so that ripper teeth 34, 35 and 36 will be operable in unison as shaft 32 is caused to rotate about its axis. Shaft 32 is operatively connected to hydraulic cylinder 37 through piston 38 connected to ripper tooth 35 through suitable connecting means, 39. Shaft 32 is disposed in suitable journals provided in the downwardly depending portion 30 of frame 29. Cylinder 37 is also connected to frame 30 through suitable means (not shown).

Proceeding to the left portion of FIG. 5 of the drawings, an extractor frame 40 is shown as including a ripper tooth frame 41 disposed on the outer extremity of an inner-boom 64 on telescoping boom assembly 61 through appropriately disposed holes 42 in ripper tooth frame 41 and holes 43 in extractor frame 40 for rotation on pin 44. It should be noted that extractor frame 40 is, for all practical purposes, fixedly disposed on the end of inner-boom 64 on telescoping boom 61. Ripper tooth frame 41 may be rotated about the axis of pin 41 through the operation of tilt cylinder 45 that is shown rotatably disposed on extractor frame 40 through appropriate hole 46 and a pin 47. Tilt cylinder 45 includes a piston rod 48 that is connected to a pin 50 extending through appropriately disposed holes 49, on ripper tooth frame 41. A plurality of journals 51 are disposed in downwardly extending appendages on ripper tooth frame 41. A shaft 52, having ripper teeth 53, 54 and 55 non-rotatably disposed thereon, is shown extending through journals 51 on the lower portion of ripper tooth frame 41.

Each of the ripper tooth members is shown having outwardly extending wedge portions 53A and a clamp tooth portion 53B for purposes to be explained below. As shown in FIGS. 1, 2, 3 and 5, the axis of rotation of shaft 52 is coincident with the axis of rotation of shaft 32 when the apparatus is in the illustated mode of scarifying the ballast underneath and surrounding a tie. Shaft 52 may be caused to rotate through the operation of hydraulic cydinder 56 that is rotatably disposed on ripper tooth frame 41 through pin 57 extending through holes 58. Cylinder 56 further includes a piston rod 59 that is shown connected to ripper tooth 54 through a connection indicated by reference character 60.

The leftwardly extending telescoping boom 61 is shown as comprising an outer member 62, a middle member 63 and an inner member 64. Outer member 62 is rotatably journaled on pin 66 disposed in appropriately positioned holes in frame 29. The top left end section of outer portion 62 of boom 61 is shown having an upwardly extending portion 68 including a pair of holes 69 and 70. A boom extension cylinder 71 is shown connected to upper extension 68 on outer boom 62 through pin 72 and further includes a piston rod 73 that is connected to extractor frame 40 through pin 51. A tilt cylinder 74 for boom 61 is likewise connected to upwardly extending portion 29A of frame 29 through appropriately positioned holes 75 and a pin 76. Boom tilt cylinder 74 is shown including a piston rod 77 connected to a pin 78 extending through appropriately disposed holes 69 in upwardly extending portion 68 of outer boom 62. It may thus be seen that ripper tooth frame 41 may be reciprocated along the longitudinal axis of boom 61 and may be tilted along an axis perpendicular to the longitudinal axis of boom 61 and that boom 61 may be tilted or rotated about its right end along the transverse axis established by pin 65.

Throughout the description of the illustrated embodiments, it may be seen that a track system is comprised of rails 84, having head portions 85 and flanges 86 mounted on ties 80, through bearing plates 81, rail anchors 82, spikes 83. The ties, 80, are shown generally immersed in a volume of the ballast of suitable density indicated by reference character 88.

With further reference to FIGS. 1, 2, 9, 10, 11, 12 and 14, the ripper teeth rotatably disposed on ripper tooth frame 41 at the end of inner-boom 64 are shown as having an inwardly extending wedge-like protrusion 53B that is adapted to engage and hold a tie 80 intermediate wedge 53B and stop members 79, extending downwardly from the lower portion of ripper tooth frame 41, so as to releasably clamp tie 80 for subsequent withdrawal and removal to one side and from underneath track 84.

Figure 13:
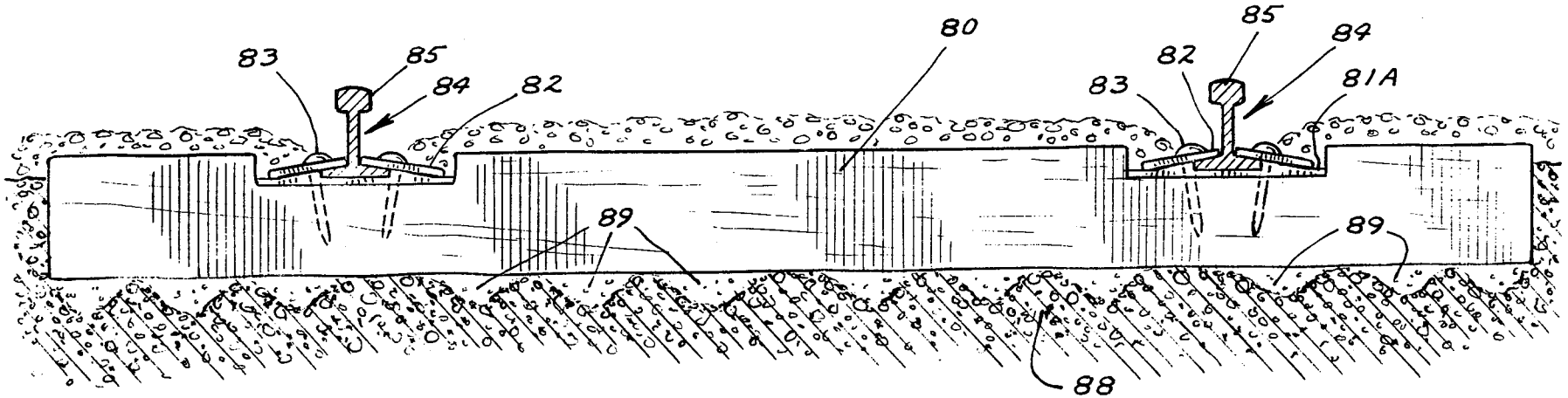
FIG. 13 is a side elevational view of a defective tie of the type to be removed through the application of the method and apparatus of the embodiment of my invention in FIGS. 1–12.
Figure 14:
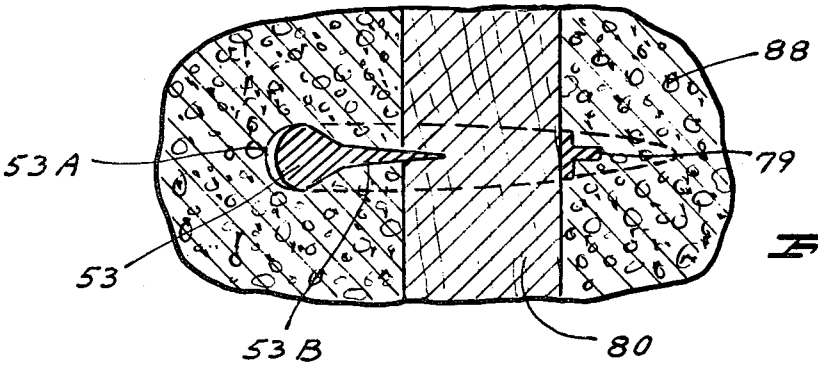
FIG. 14 is a sectional view taken along section line 14—14 on FIG. 12.
Figure 15:
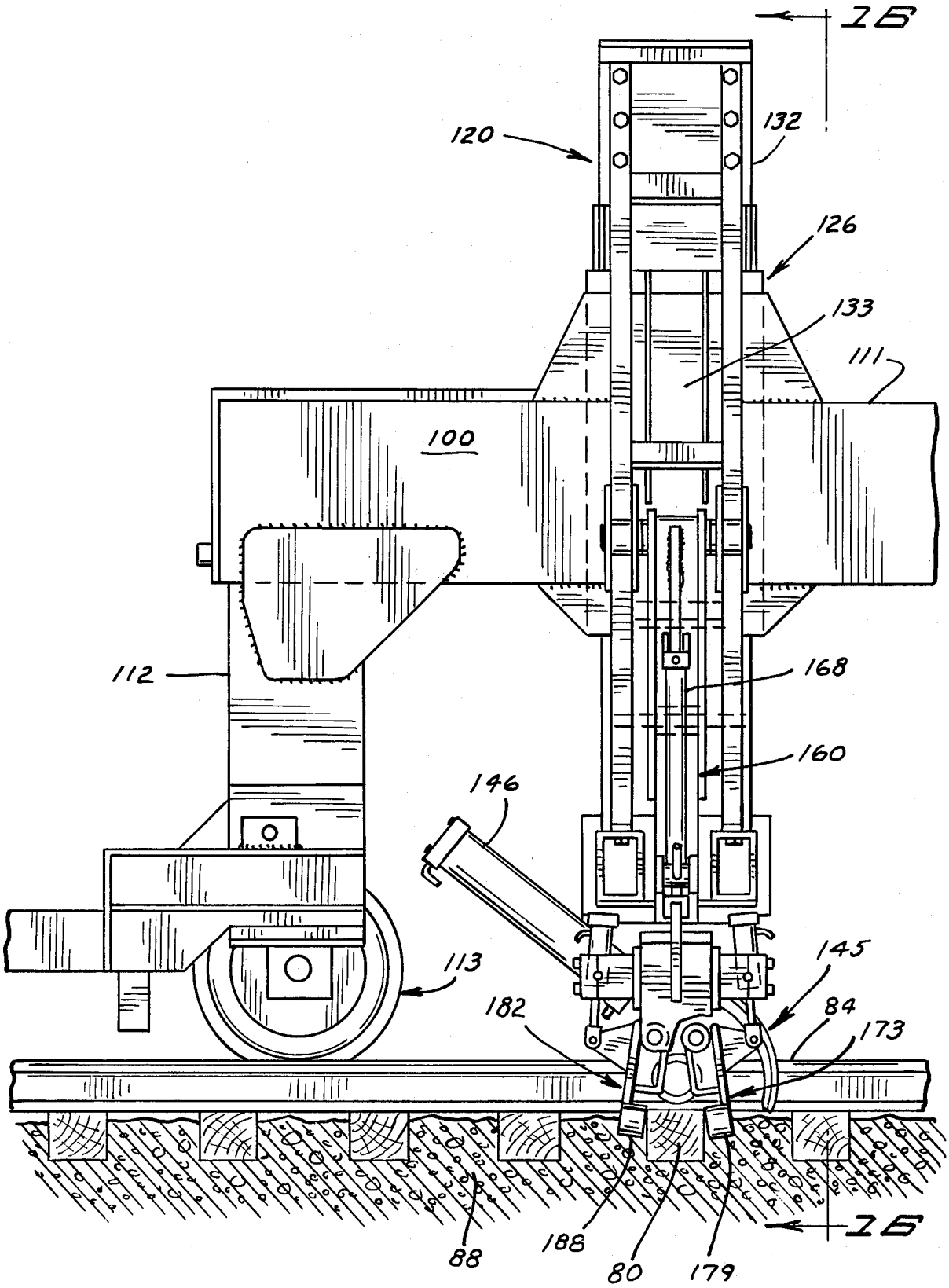
FIG. 15 is a fragmentary side elevational view of a second embodiment of my apparatus.
Figure 16:
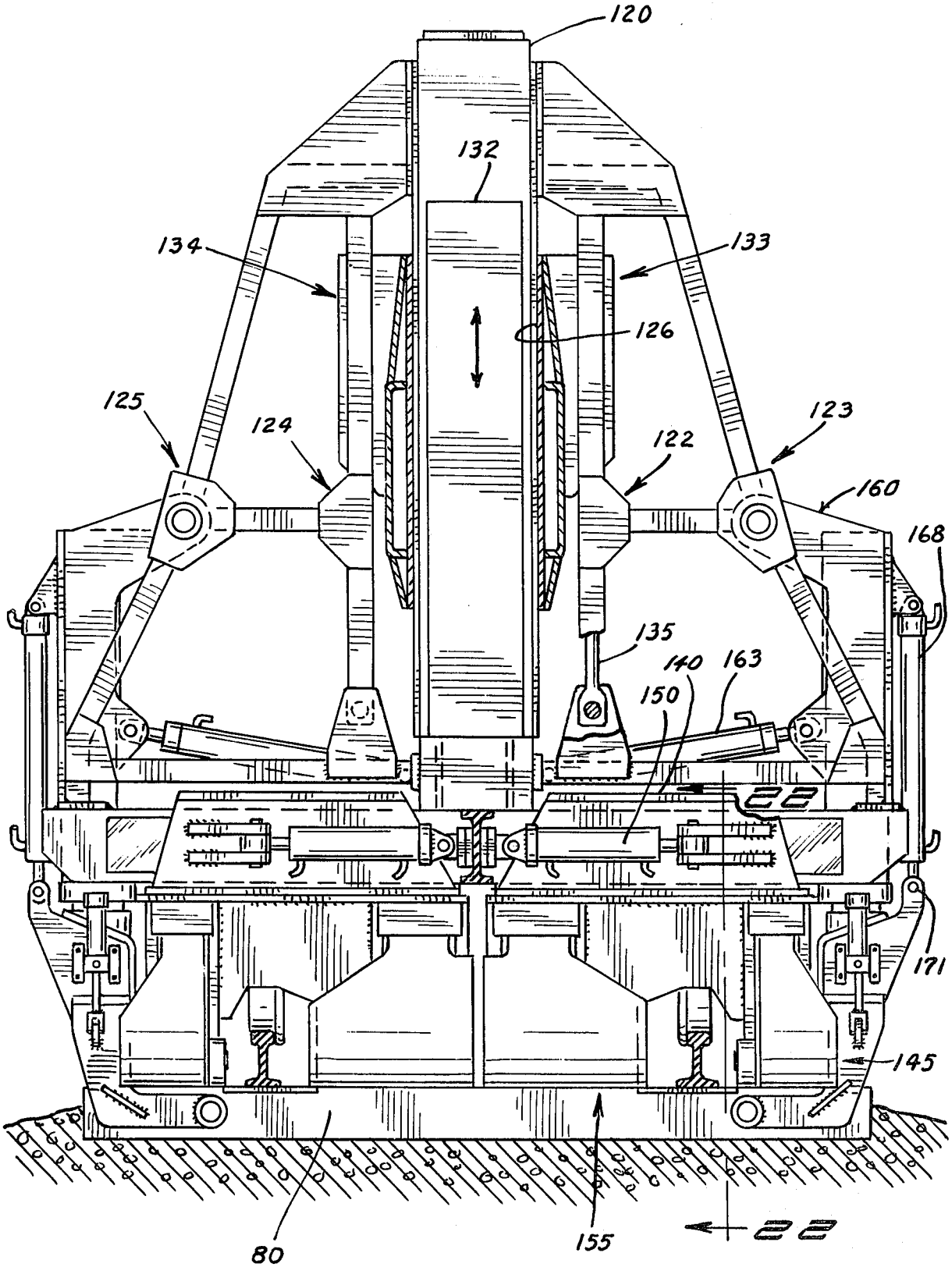
FIG. 16 is a rear elevational view (partly in section) of the apparatus shown in FIG. 15.

Referring to FIG. 13, recessed volumes 81A in the top surface of tie 80 are shown in exaggerated dimension to illustrate the difficulty presented by the plate cuts that are caused by movement of traffic over the track system to illustrate one of the problems necessitating the application of the principles of my invention to the facile removal of defective individual ties from a track system.

It may now be apparent to those skilled in the art to which this invention pertains, that the operation of the tie extractor apparatus 10 is essentially of two phases; the first involving the lateral scarifying or, otherwise, displacement of ballast material from beneath the tie to be removed; and the second consisting of the withdrawal of the tie from either side of the track system by further operation of the extractor apparatus 10 after the tie has been lowered sufficiently so that the bearing plate cuts existing in a typical tie will sufficiently clear the lower surface of the flange of the rails so as not to disturb the position of the rails with respect to the remainder of the track system.

The first phase of operation contemplates a simultaneous partial rotation of all of the ripper teeth assemblies on the tie extractor frames 41 and work head frame 29 with substantially coincident axes so that, as the rippers are rotated into operative ballast displacing position beneath the tie, they will be operative in a substantially uniform position with respect to the tie to laterally displace the ballast material into an adjacent crib of the track system. For this purpose, it may be noted that the axis of rotation of the ripper teeth on shaft 52 in ripper teeth frame 41 is displaced from the longitudinal axis of boom assembly 61 as may be seen in FIGS. 1 and 2 and from this, those skilled in the art will realize that the same offset relationship will obtain or be present with respect to the extractor frame and ripper tooth frame disposed on the outer end of the other telescoping boom assembly to which like reference numerals may be applied for the purpose of operation.

Figure 9:
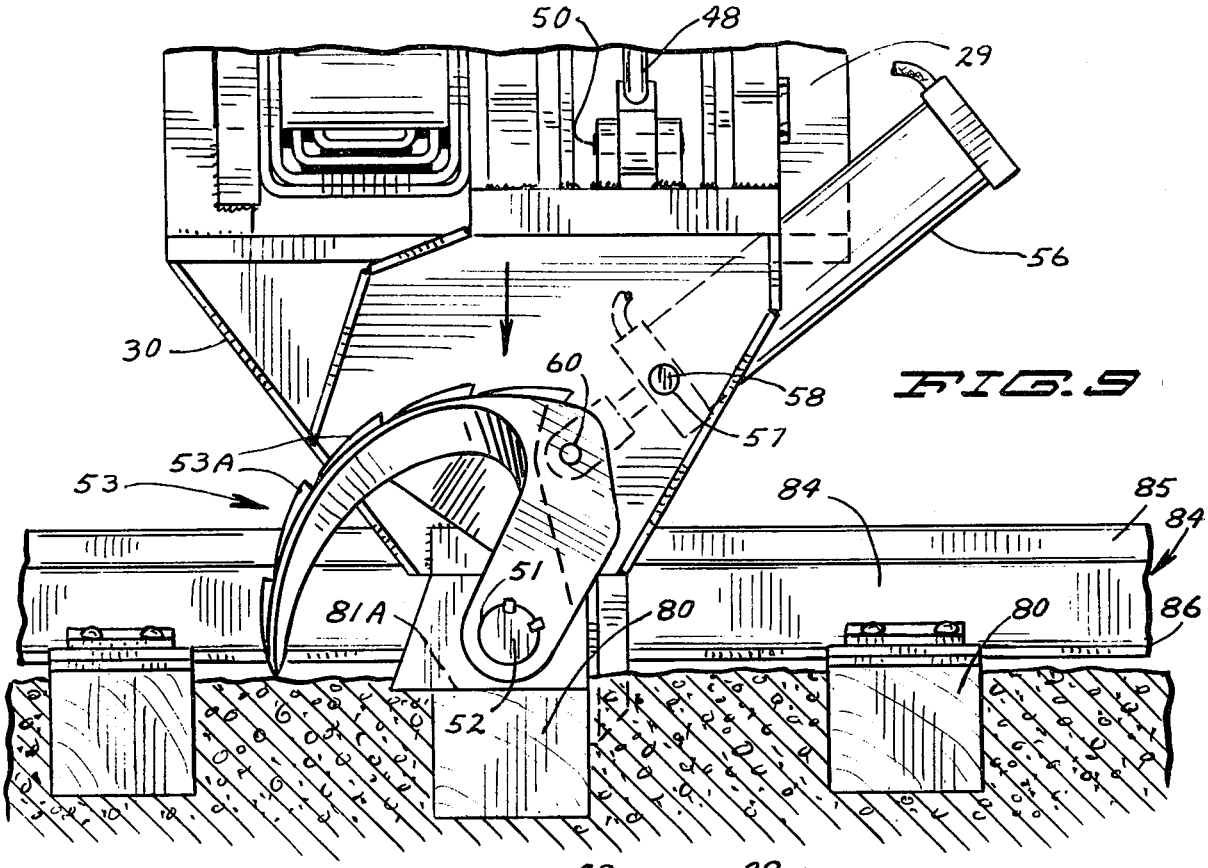

The second mode of operation contemplates that the ripper teeth assemblies disposed on the lower end of work head 20 are rotated out of engagement with the tie, as in the retracted position illustrated on FIGS. 1 or 9, and one or the other of the extractor frame assemblies will also be retracted while the other extractor frame assembly will be retained in a firm clamping engagement with one end of a tie 80 as shown on FIGS. 2 and 12.

OPERATION OF THE FIRST EMBODIMENT

Tie extractor apparatus 10 is intended to be self-propelled and, for reasons of simplicity, the driving mechanism typically connected to power plant 14, is not shown. Power plant 14 also typically includes a suitable hydraulic pump system that is connected to all of the operating cylinders of the apparatus through suitable valves positioned at the operator console 17 and to the individual cylinders through suitable hydraulic tubing.

Figure 3:
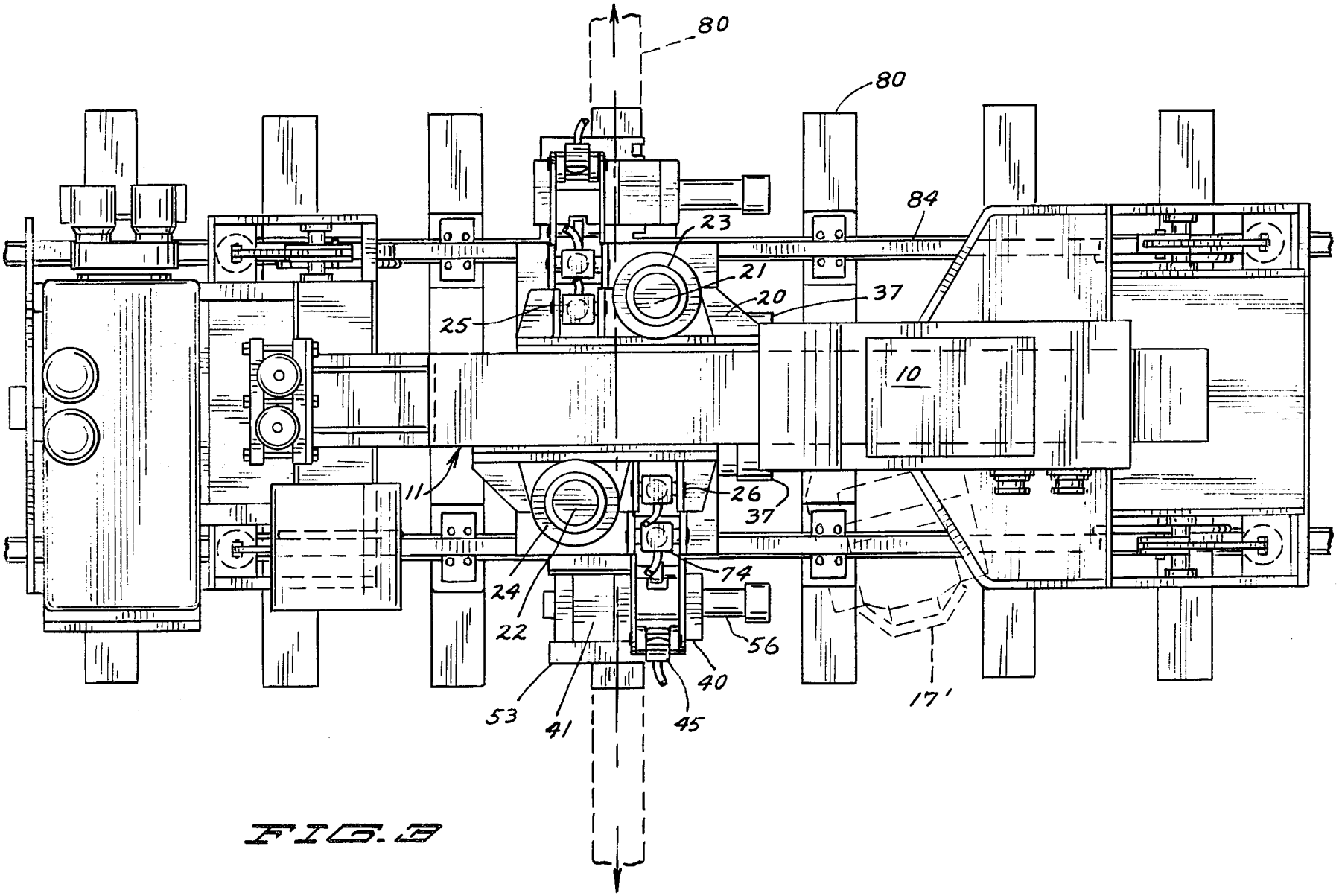
FIG. 3 is a top plan view of the apparatus shown in FIGS. 1 and 2.

In a typical extraction of a defective tie, the apparatus is positioned over the tie as indicated in FIG. 3 of the drawings so that the longitudinal central axis of the tie is disposed along a line extending laterally of the track system and is substantially between journals 23 and 24 for work head tubes 21 and 22 and the axis of shafts 52 in ripper teeth frame 41 will likewise be coincident with the axis of shaft 32 in the ripper tooth assembly disposed on the lower end of work head 20. It will be assumed that the spikes and anchors for rail 80 have previously been extracted from an effective tie, 80, and work head 20 may now be lowered to a position with the lower end resting adjacent or on the top surface for the tie. It may also be noted that with the apparatus in its lowered position adjacent the top surface of a tie, 80, stop members 79 extending downwardly from work head 20 and from ripper tooth frames 41 will be coincidentally disposed along one top side of tie 80 to position or maintain the position of tie 80 with its longitudinal axis substantially, perpendicularly lateral to the track system so as to prevent movement of tie 80 during the subsequent scarifying operation of displacing the ballast from underneath the tie into the adjacent crib of the track system.

Figure 10:
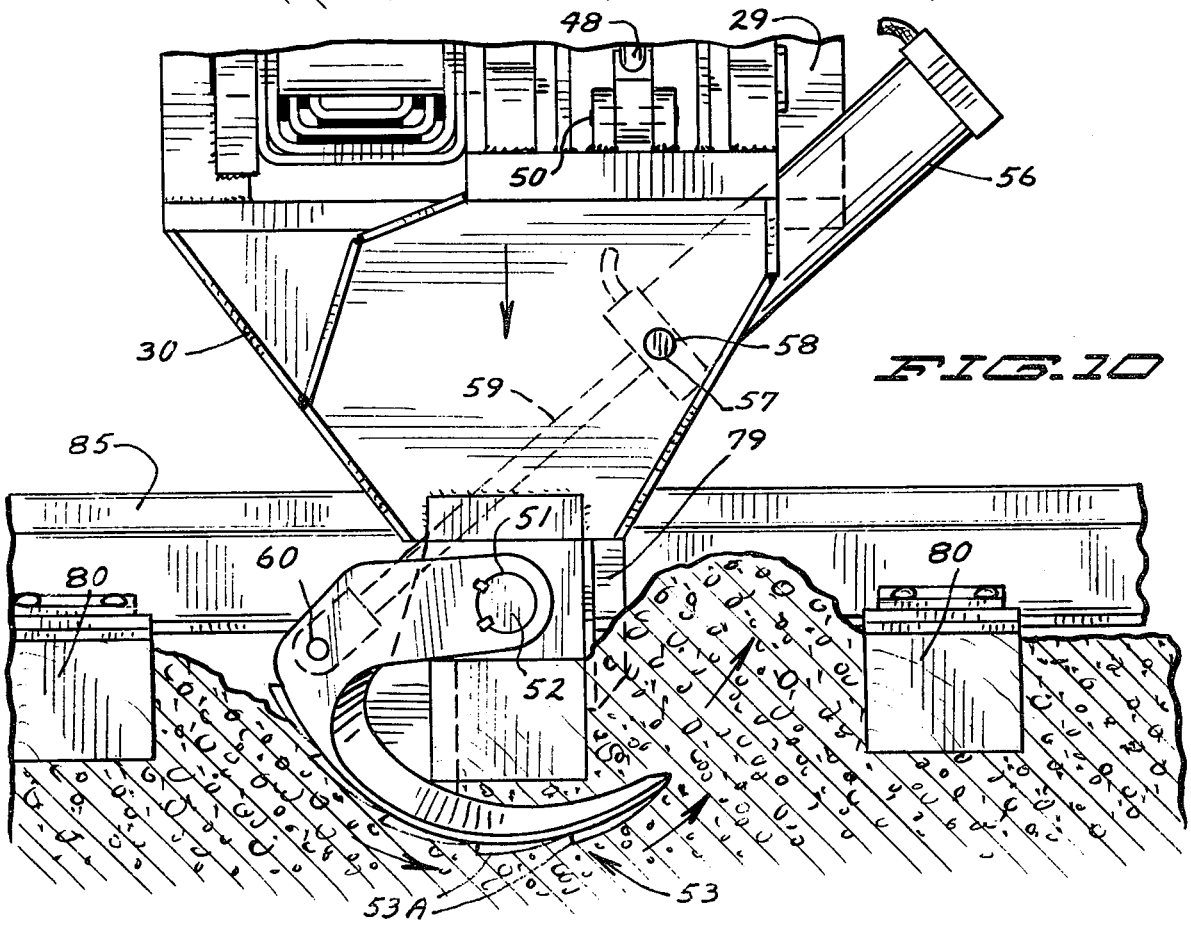

The operator may then energize hydraulic cylinders 37 and 56 to cause all of the ripper teeth to rotate about the axis of shafts 32 and 52 as shown in FIGS. 2, 9 and 10 to effect a lateral displacement of the ballast adjacent and underneath a tie, 80, as the ripper teeth proceed to the position illustrated in FIG. 10. The operator may then apply the entire weight of work head 20, by suitable operation of cylinders 25 and 26, to the top of tie 80 and actuate hydraulic cylinders 37 and 56 in reverse to withdraw the ripper teeth in each of the assemblies as illustrated in FIGS. 11 and 12 to thereby create a plurality of longitudinally spaced-apart pockets, 89, underneath tie 80 as shown in FIG. 13. As the ripper teeth are withdrawn through the conjoint action of the wedge or barb-like protrusions on the lower surfaces of the ripper teeth and the additional weight of the work head on top of the tie, further ballast material is removed to enlarge the relative size of pockets 89 underneath tie 80. It may be noted that the forward immersion of the respective ripper teeth about their axes of rotation to a position underneath tie 80 will result in a pumping action in the chamber defined by the undersurface of tie 80 and the ballast bed below, to effect a shearing, loosening and ejection of the ballast material without resulting in additional compaction of the adjacent ballast material so as to retain the desired ballast bed density for proper operation of the track system. A typical lateral ballast removal operation results in a lowering of the level of a tie to approximately two inches below the level of tracks 84 in the track system and is considered to be a reasonably operative standard for the apparatus of my invention.

It may be noted that the lateral displacement of the ballast material adjacent to and underneath tie 80, in the manner presented, provides for the lateral movement or flow of ballast material, in the present embodiment, in both directions, which does not tend to compact or increase the density of the remaining adjacent ballast material that is left in place. The non-vibratory pumping action, including the shearing forces exerted by the ripper teeth upon immersed movement through the ballast adjacent to and underneath the tie, is believed to contribute substantially to the improved results that are obtained upon subsequent replacement of the tie and adjacent ballast.

Figures 7, 8:
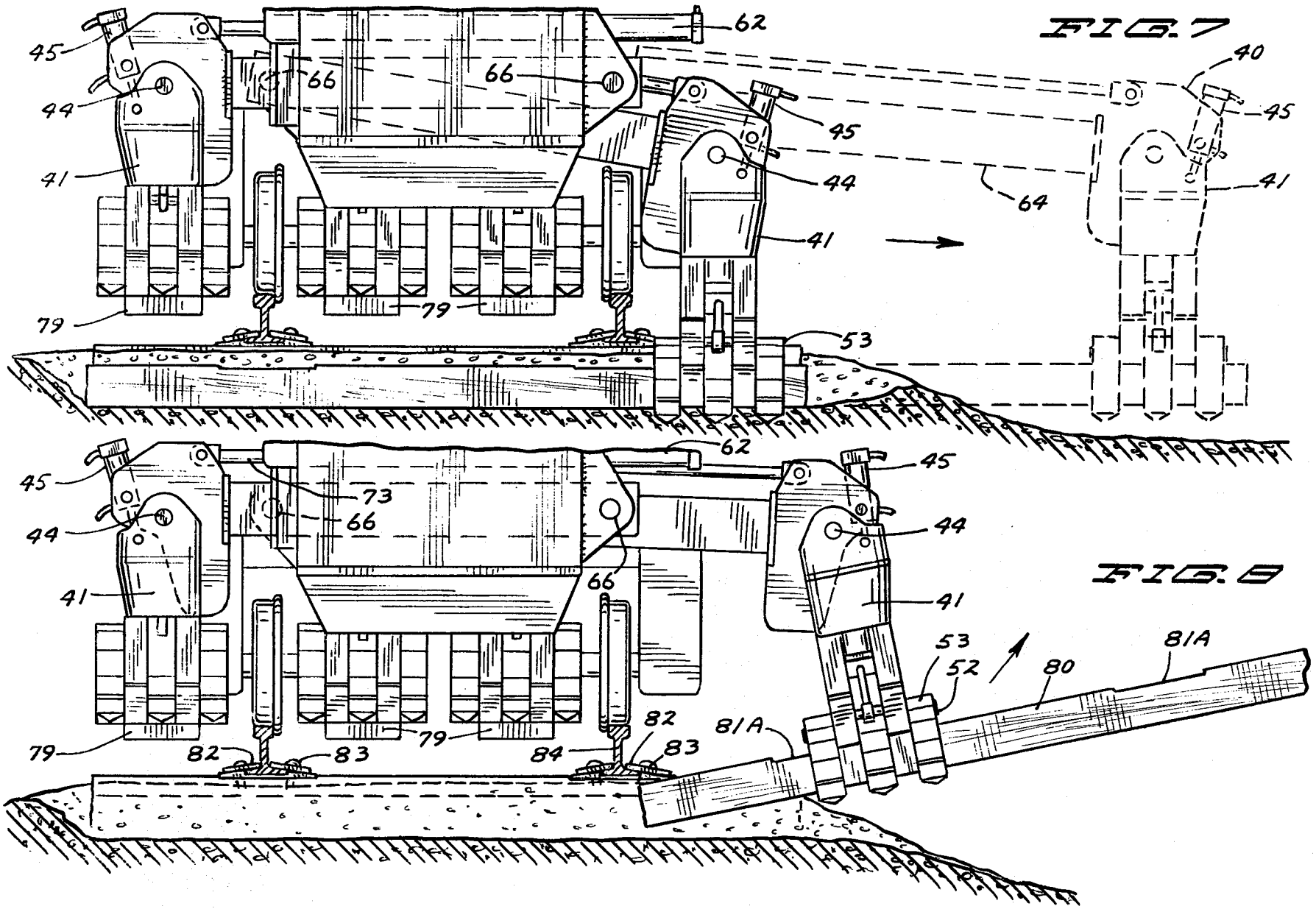

Once the tie has been lowered, it may then be extracted by clamping one or the other of extractor frames 40 on the end of extendible booms 61 (as illustrated in FIGS. 7 and 8) by clamping the tie with ripper teeth 53, 54 and 55. The conjoint operation of wedge 53B and stop 79 and extending the boom outwardly through suitable operator control of cylinder 62 will complete the removal of a defective tie 80. Under certain circumstances, such as tie removal along a track system having limited side clearance, it may be desirable to release the tie during the process of extraction and move the end of boom 61 to a position intermediate the ends of the tie.

Figure 4:
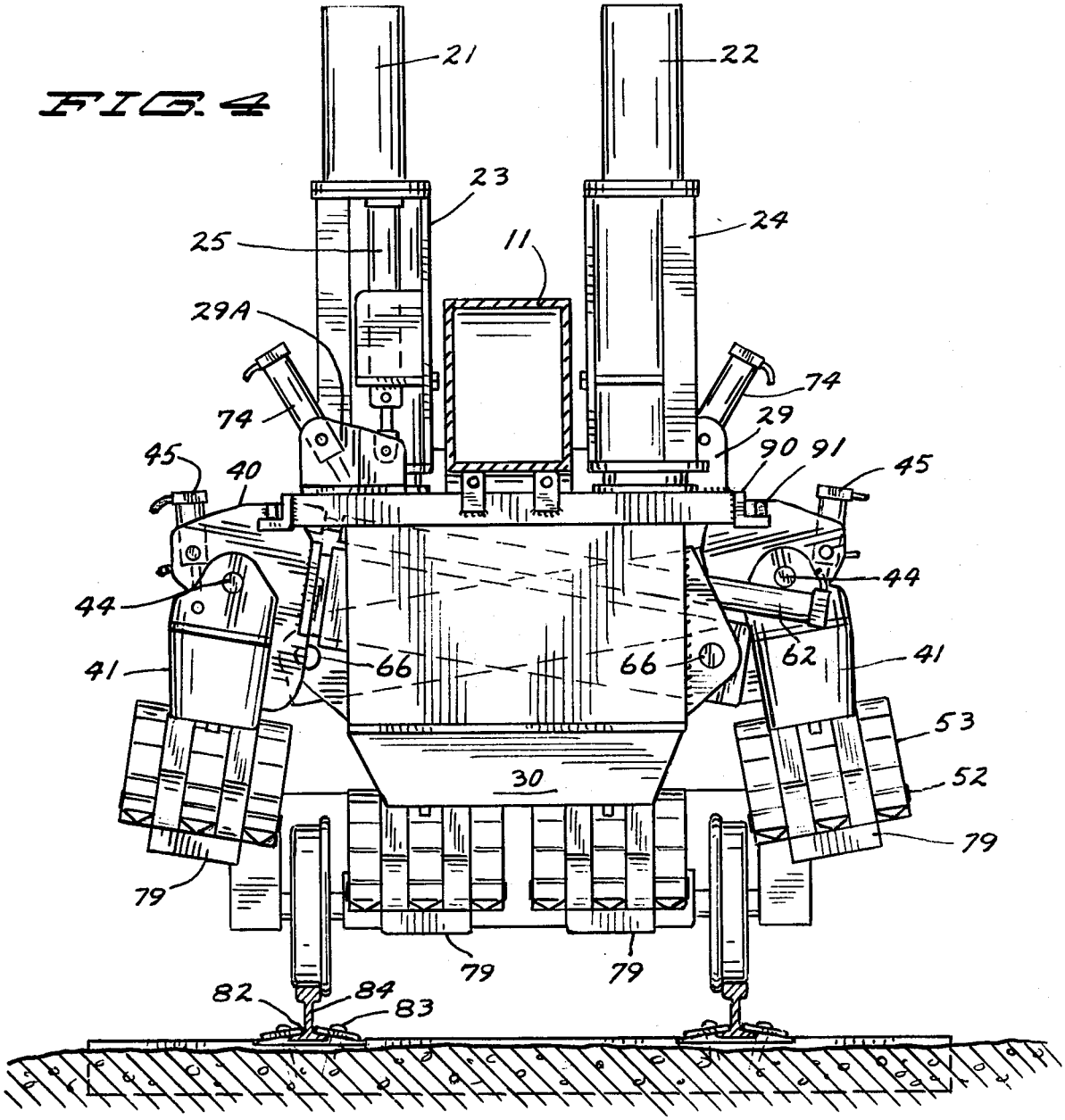
FIG. 4 is a sectional view taken along section line 4—4 on FIG. 1.
Figure 6:
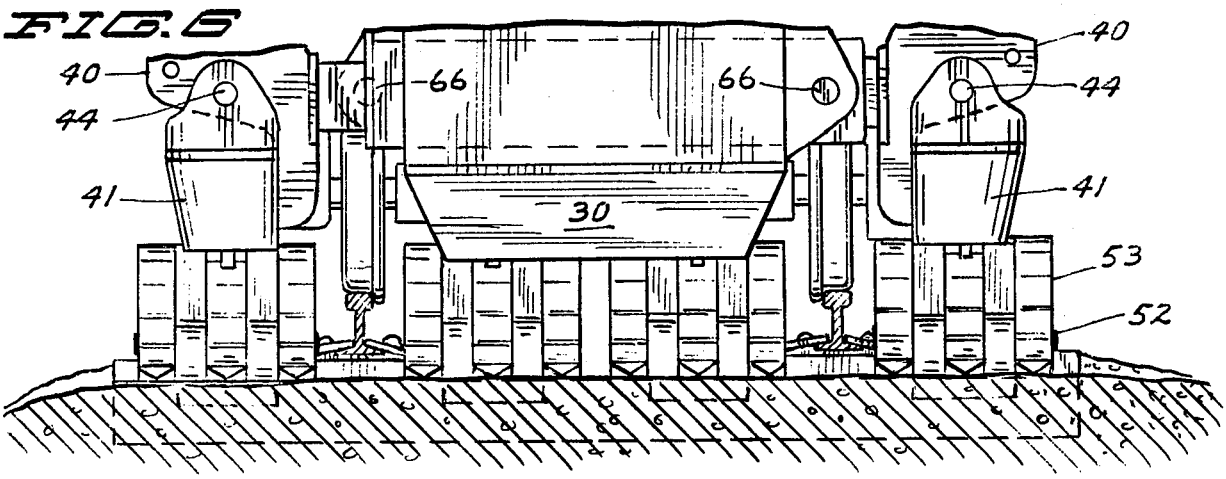
FIGS. 6, 7 and 8 are fragmentary views of portions of the apparatus of FIGS. 1 and 2, in different phases of operation.

As shown in FIG. 4 of the drawings, extendible booms 61 may be stored in a retracted storage position for transport to other locations. This is provided by means of the suitable outwardly extending projections 90 on portion 29A of frame 29 and complementary configured projections 91 disposed on extractor frames 40 on telescoping booms 61.

DESCRIPTION OF THE SECOND ILLUSTRATED EMBODIMENT

In the second embodiment of my invention, as illustrated in FIGS. 15–23, inclusive, like reference characters have been applied to like elements and it may be noted that a basic similarity is present in connection with the overall configuration of the tie extractor insofar as the main frame and transport elements are concerned.

Referring to the drawings, a tie extractor apparatus is indicated generally by reference character 100 and includes a longitudinally extending main frame 111 that is provided at its rear end 112 with a railroad truck 113. It is to be understood that the other end of main frame 111 is likewise suitably supported and that a source of motive power is disposed on one or the other of the ends of tie extractor apparatus 100 and that the source of motive power may include suitable means for providing hydraulic fluid under pressure to be applied, through suitable valve means (not shown), under the control of an operator for actuation of the various elements of the invention shown in the drawings and described below.

A work head 120 is shown vertically reciprocably disposed in a vertically oriented journal 126 extending through a horizontal portion of main frame 111. Work head 120 is shown configured to have a generally inverted T shape having a main vertical portion 121 reciprocably disposed in main frame journal 126 and a generally horizontally disposed lower horizontal portion 129. Right and left side structural members interconnect the top end of vertical portion 121 to the laterally spaced top portions of lower horizontal member 129. The right side includes a vertical member 122 and a slanting member 123 and the left side includes vertical member 124 and a slanting member 125. Right and left tilt cylinders 133 and 134 are shown having their top ends disposed adjacent journal 126 in the horizontal portion of main frame 111 through appropriate means (not shown) and each has a downwardly depending piston that is shown, in the case of piston 135 on cylinder 133, in the fragmentary sectional outline on FIG. 16. The conjoint operation of cylinders 133 and 134 will serve to vertically position work head 120 with respect to the horizontal portion of main frame 111.

The vertical portion of T shaped work head 120 is shown having a surface layer of suitable plastic material, 132, such as Teflon, disposed on the four surfaces for reciprocation within journal 126 on main frame 111. Similarly, the horizontal outward portions of lower horizontal member 129 on work head 120 are provided with surface mounted areas of similar suitable plastic shown as right areas 130 and left areas 131. Vertical section 121 and horizontal section 129 on work head 120 may be suitably attached at the center of horizontal section 129 by welding or the like.

Right and left ripper, or scarifier, slide frame members 140 and 141 are shown reciprocably disposed for horizontal movement on lower horizontal member 129 on work head 120. In view of the symmetry exhibited by the illustrated configuration, the right ripper slide frame 140 will be described in detail only. Ripper slide frame 140 is shown having a downwardly depending lower end 142 which is, in essence, bifurcated to provide for the rotatable mounting of outer ripper 145 and inner ripper 155. The outermost portion of lower end 142 is provided with a tie stop 143 and is configured to receive a shaft 144 upon which is mounted a ripper, or scarifier 145, having a body portion 148 and a leading edge 149, of suitable blunt shape. Ripper 145 may be rotatably operated through operation of cylinder 146, having a piston 147, as illustrated in FIGS. 122 and 123. The other end of section 142 on right ripper slide frame 140 is shown having a tie stop 153 and also rotatably carries a shaft 154 upon which is mounted a further ripper, or scarifier, 155. Ripper 155 may similarly be operated through the conjoint action of a cylinder (not shown) mounted similarly to that shown for ripper 145 and which is connected thereto through a piston 157, as shown on FIG. 20 of the drawings.

Figure 20:
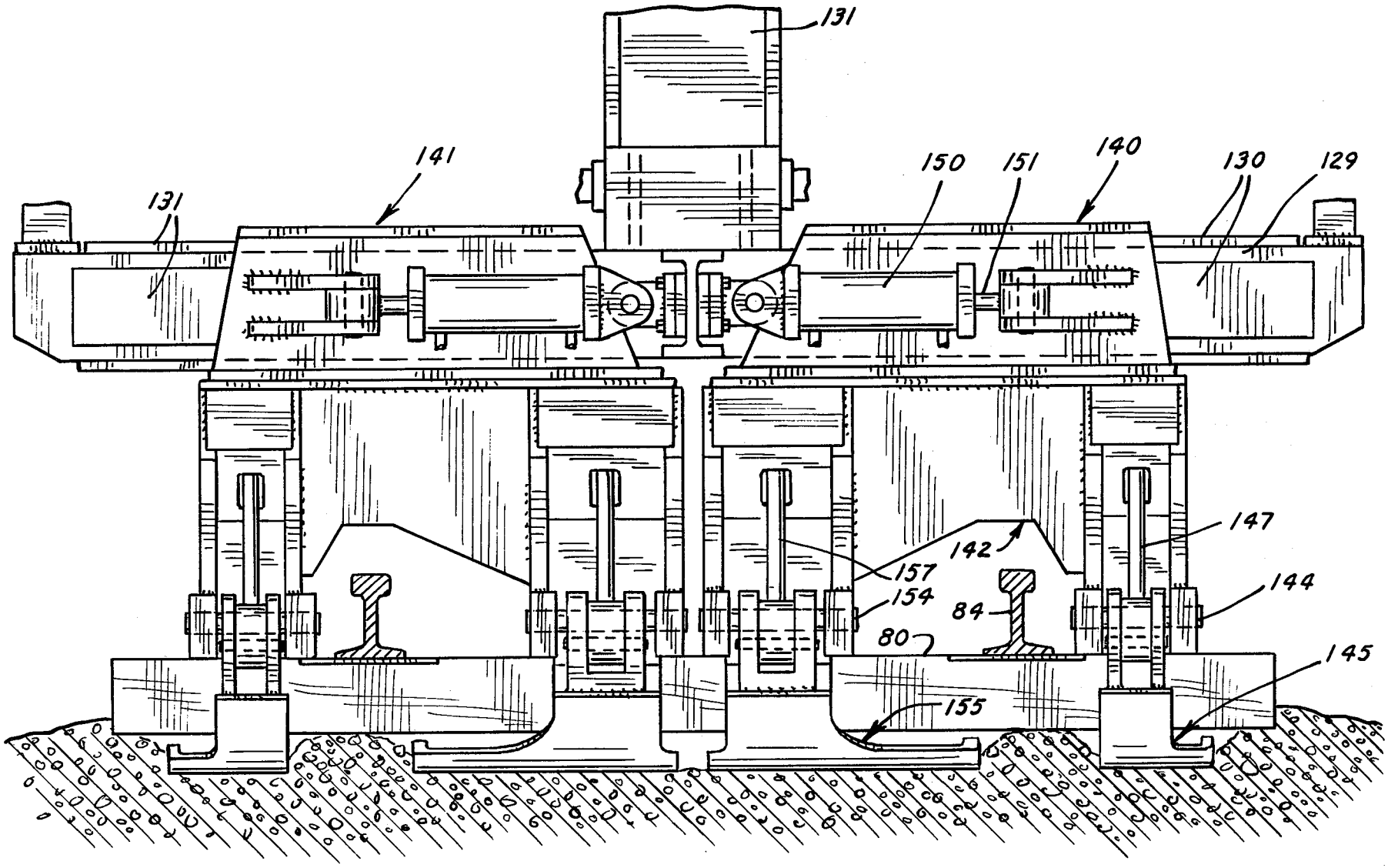
Figure 27:
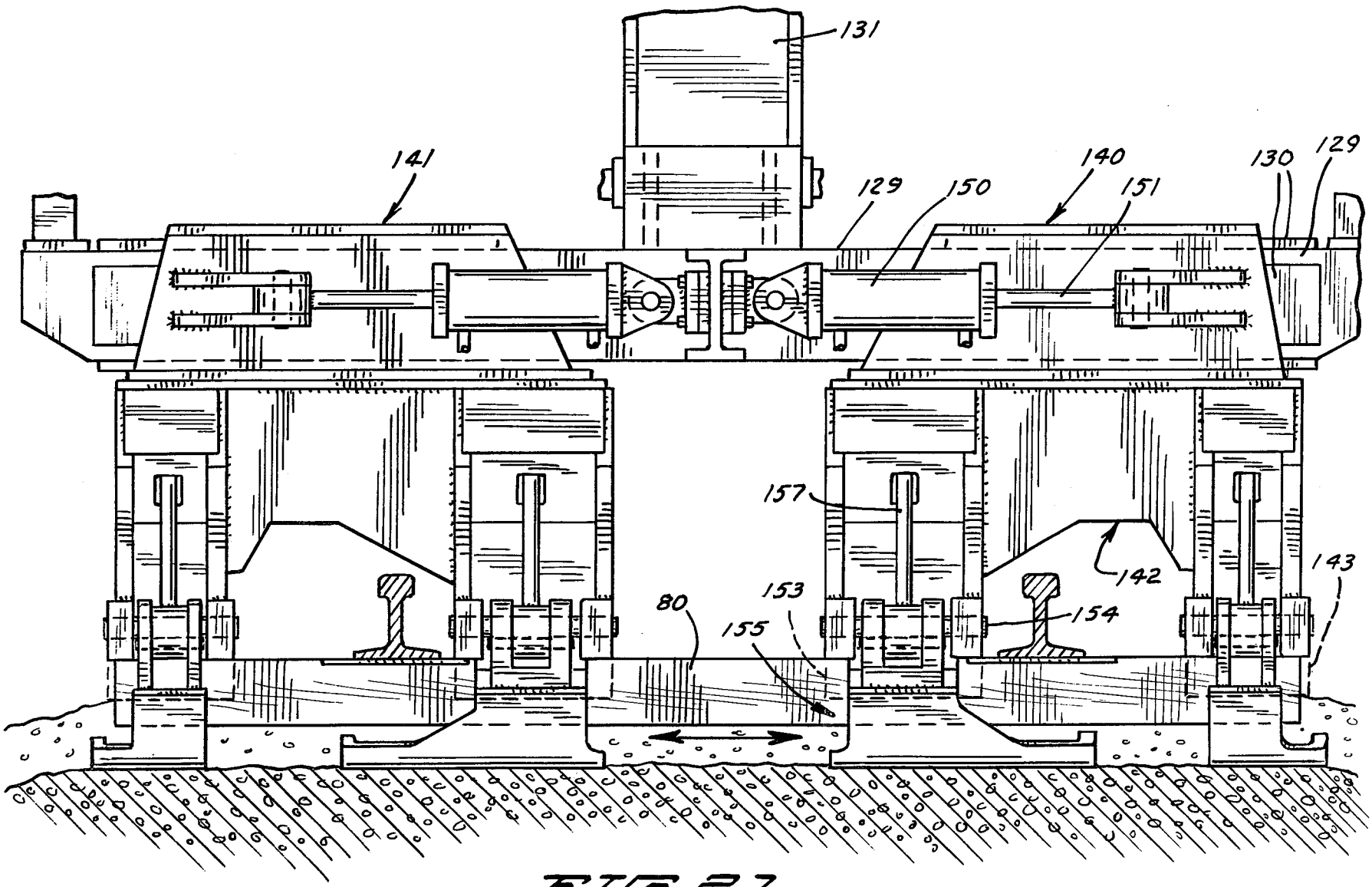

A cylinder 150 and piston 151 are shown connected intermediate the center portion of lower horizontal section 129 on work head 120 and right ripper slide frame 140 for effecting the horizontal reciprocal movement that is illustrated in FIGS. 20 and 21. As will be referred to below in connection with the operation of the second embodiment of my invention, it may be seen that a plurality of ripper teeth are essentially simultaneously laterally rotatable and longitudinally moveable underneath the lower surface of a tie.

A pair of swingably rotatable and longitudinally extendible extractor booms are disposed to be operable adjacent each end of lower horizontal portion 129 of work head 120. In view of the symmetry exhibited by the illustrated apparatus, the right extractor boom is identified by reference character 160 and will be described in detail with the understanding that one skilled in the art may easily determine the relationship between the elements of the similarly constructed left boom.

Referring to FIGS. 16, 17, 18 and 19, it will be seen that extractor boom 160 is provided with a top portion 161, that is swingably rotatably disposed on a pin 162 extending through right side slant frame 123 on work head 120, and further includes a lower section 163, longitudinally, slideably disposed within top section 161 for reciprocation therein as will be described below.

A swing cylinder 164 is shown connected to section 129 on work head 120 through a pin 155 and includes a piston 166 having an outer end connected to top portion 161 on extractor boom 160 through pin 167. An extractor boom extension cylinder 168 is shown connected at its upper end to top section 161 through a pin 169 and includes a piston 170 connected to lower section 163 through pin 171. Lower section 163 of extractor boom 160 is provided with a surface of suitable plastic, 172, for purposes as described above.

Figure 17:
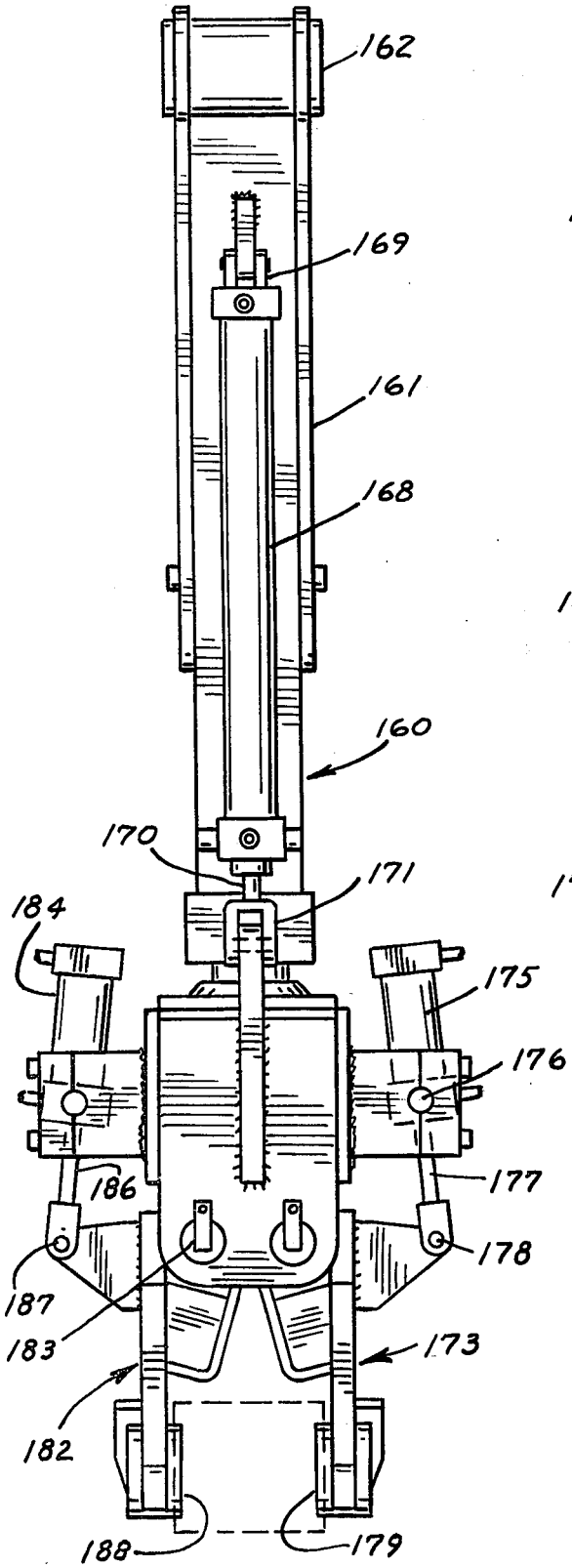
FIG. 17 is an enlarged side elevational view of a portion of the apparatus shown in FIG. 15.
Figure 18:
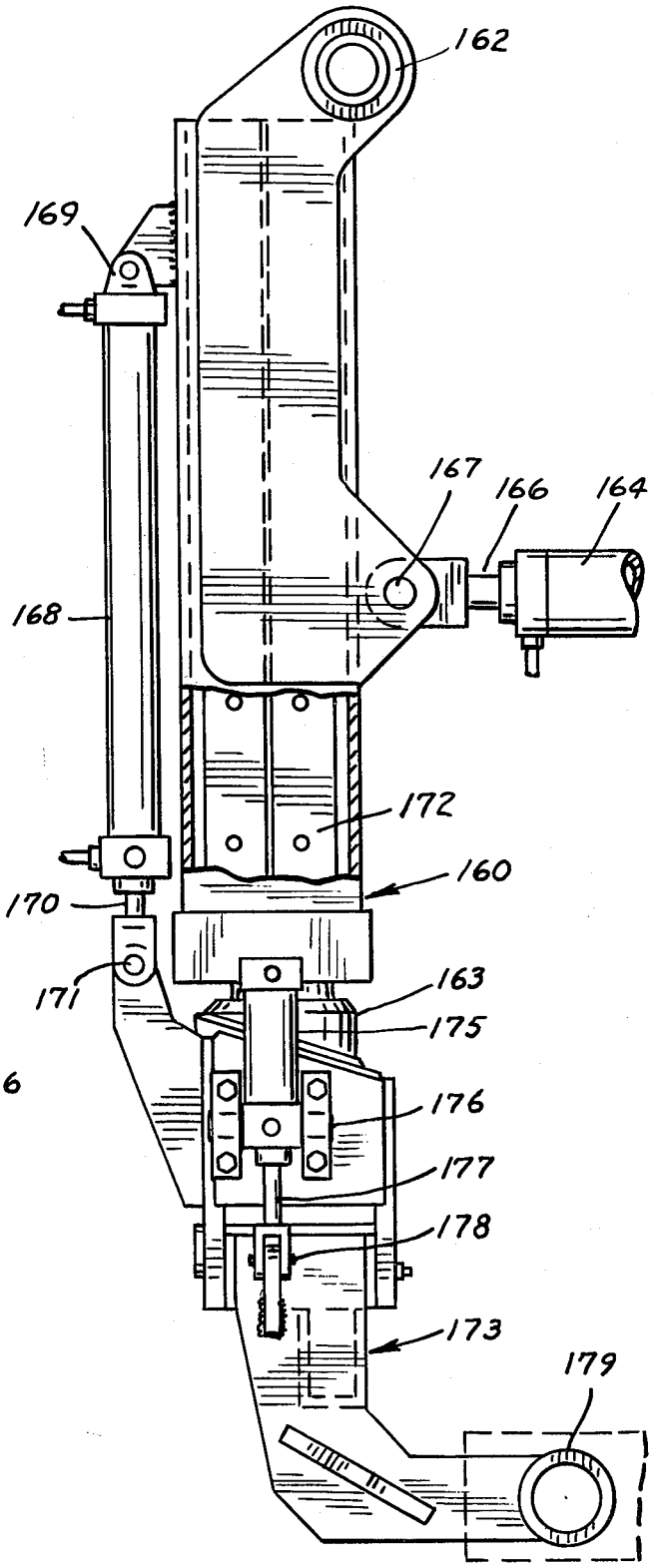
FIG. 18 is a rear elevational view (partly in section) of the apparatus shown in FIG. 17.

Referring to FIG. 17 of the drawings, a pair of tie clamp arms 173 and 182 are shown rotatably disposed on pins 174 and 183 that extend through the lower end 163 of extractor boom 160. Tie clamp arm 173 is rotatable about pin 174 through operation of cylinder 175 having one end disposed on a pin 176, and including a piston 177 connected to pin 178. A generally cylindrical tie connector means 179 is shown disposed on the lower extremity of tie clamp arm 173 for clamping, rotatable engagement with the side of a tie 80. Similarly, tie clamp arm 182 is rotatably operable about pin 183 through operation of cylinder 184, having one end disposed on a pin 185, and including a piston 186 connected to tie clamp arm 182 through pin 187. A similarly cylindrically shaped tie connector 188 is shown disposed on the lower extremity of tie clamp arm 182 for rotatably engaging the other side of a tie 80. It may thus be seen that tie extractor booms 160 are provided with means to rotatably engage and clamp on to the end of a tie to be removed at their lower end, are longitudinally extendible, laterally outwardly swingable about pivot pin 162 on work head 20 and vertically reciprocable, to provide a multiplicity of motions that may be combined through the efforts of an operator to withdraw a tie from either end from under a track system to provide a program of operation that requires a minimum amount of side clearance adjacent the track system.

OPERATION OF THE SECOND EMBODIMENT

Figure 22:
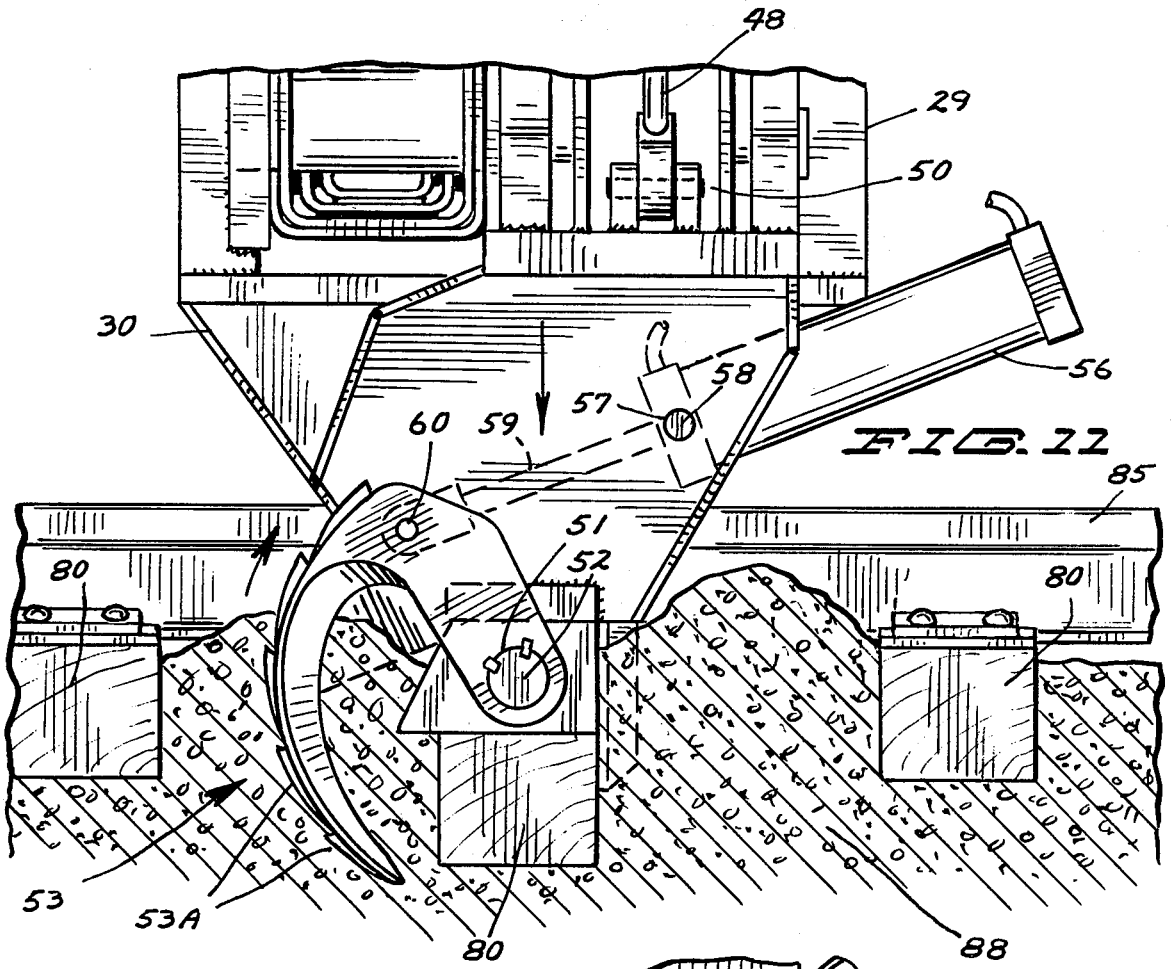
FIGS. 22 and 23 are enlarged fragmentary sectional views of a further portion of the apparatus of FIG. 15 shown in two different positions of operation.
Figure 22:
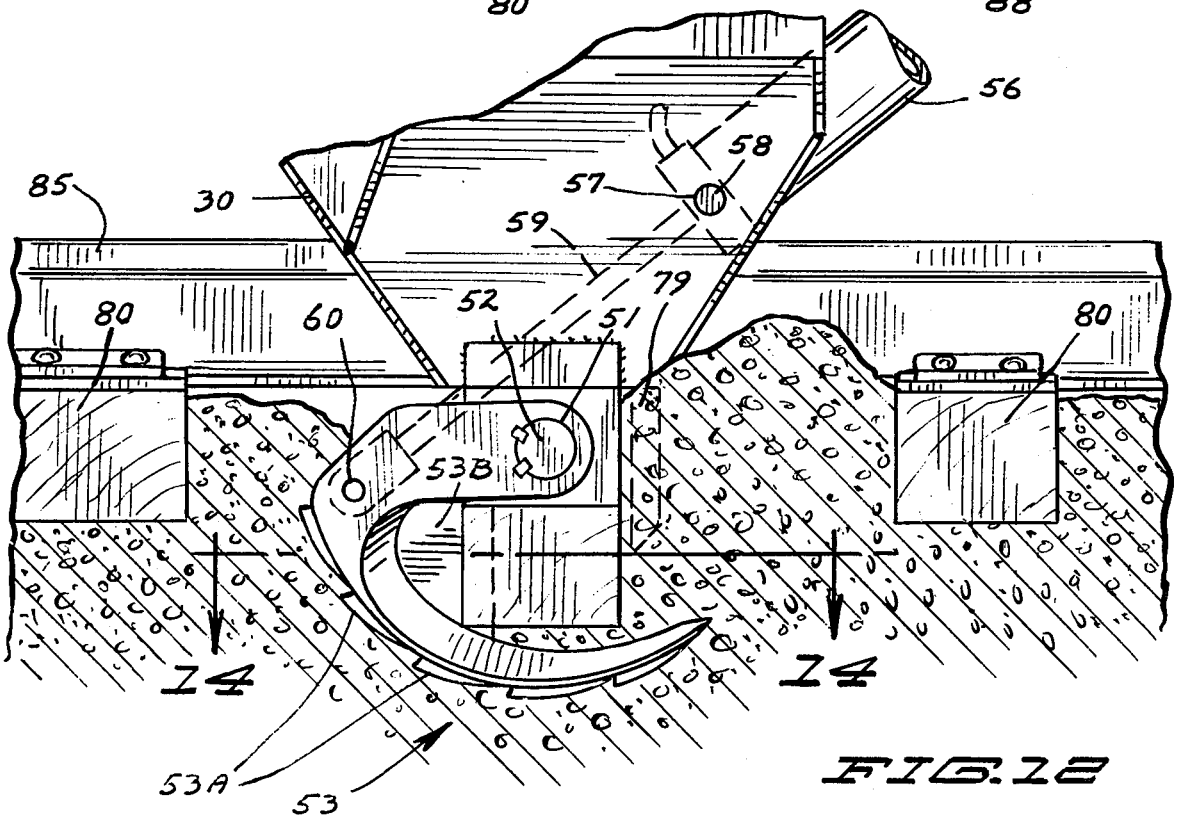

Having determined the existence of one or more defective ties in a track system, the apparatus of tie extractor 100, normally self-propelled (not shown), is moved along the track right-of-way and, as the lower portion of work head 20 approaches a tie to be removed, work head 20 is lowered to a position whereat its lower extremity is adjacent the top surface of the tie and stop members 143 and 153 are caused to engage one side of the tie to be removed. With the tie in a position substantially perpendicular to the longitudinal axis of the track system, tie extractor 100 is stopped. At this time, rippers 145 and 155 are in a retracted position as shown in FIG. 22 and extractor booms 160 are disposed in an outward position which may be that illustrated in FIG. 19, without the presence of tie 80. It may also be noted, as was the case with the first described embodiment, that a tie, 80, is restrained by stops 143 and 153 on the lower surface of right and left ripper slide members 140 and 141.

Figure 23:
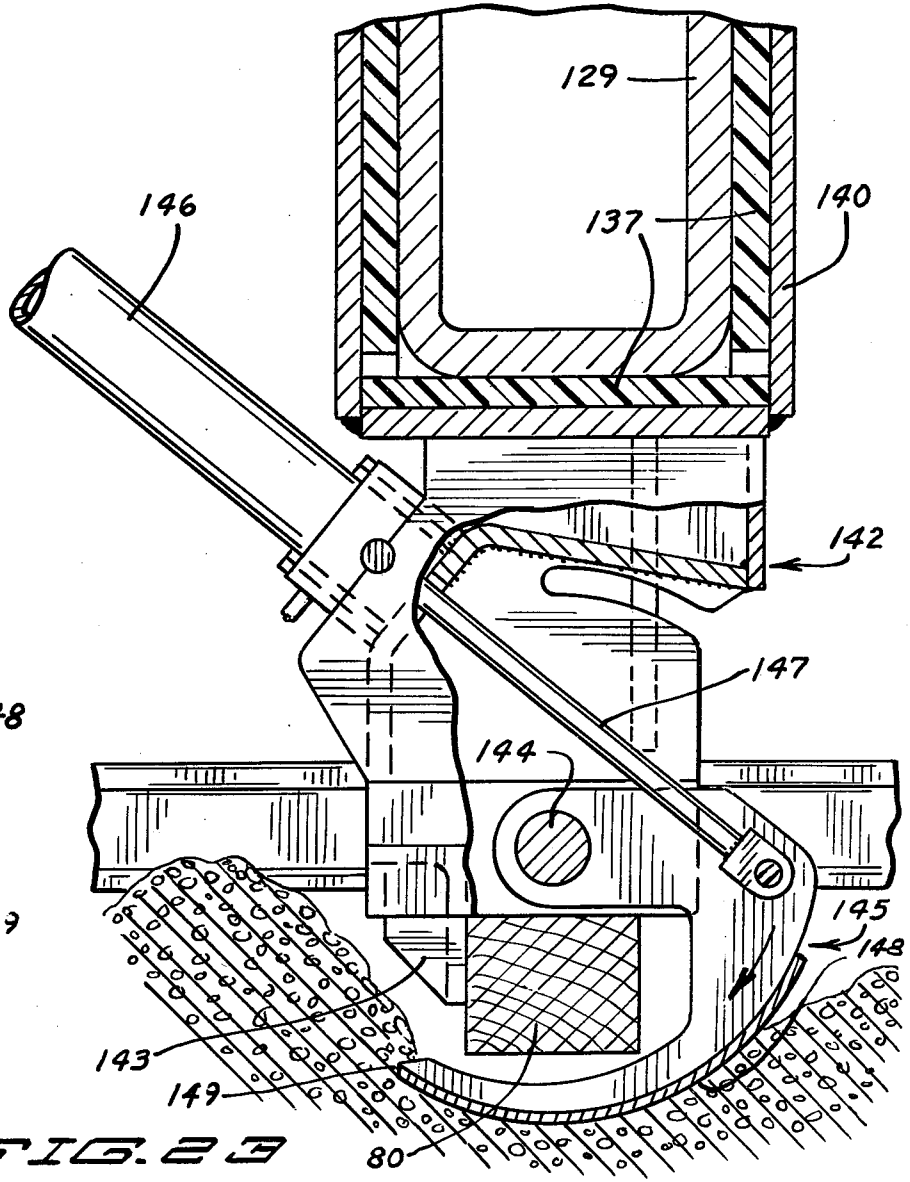
Figure 22:
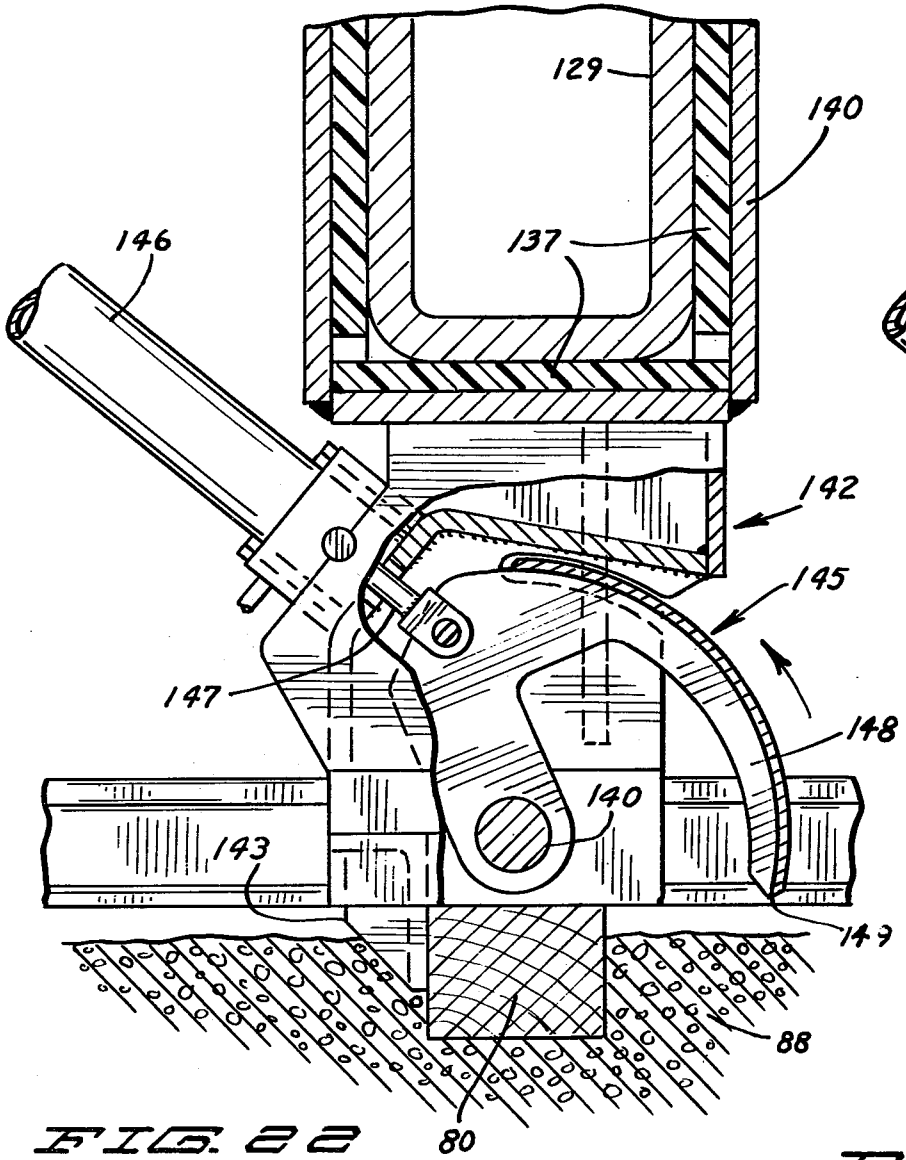

The operator, through appropriate valving means (not shown), may then proceed to apply hydraulic fluid under pressure to the cylinders, such as 146, attached to each of the ripper teeth 145 and 155 to cause rotation from the initial position shown in FIG. 22 to the final position shown in FIG. 23 to effect a pumping action of the ballast disposed underneath the tie forwardly and upwardly to the next adjacent crib, in which stop members 143 and 153 are in engagement with the other side of tie 80, without compacting the adjacent ballast material that is not displaced. With ripper teeth 145 and 155 in the immersed position of FIG. 23, the operator may then apply hydraulic fluid under pressure to cylinder 150 to cause movement of ripper slide frames 140 and 141 from the position shown in FIG. 20, outwardly to the position shown in FIG. 21 to effect a side-wise displacement of material longitudinal of tie 80 that may be present underneath rails 84, again without exerting any substantial compacting force on the adjacent ballast material underneath and surrounding tie 80. Following this, the operator may again move ripper teeth slides 140 and 141 to the center position of FIG. 20, cause a retraction of ripper teeth 145 and 155 and then complete a further cycle of rotation of ripper teeth 145 and 155 to complete the removal of the ballast from underneath tie 80. With ripper teeth 145 and 155 in the retracted position of FIG. 22, the operator may then energize lift cylinders 133 and 134 to exert a further downward force on the top surface of tie 80 to cause it to assume a lowered position underneath rails 84.

Figure 19:
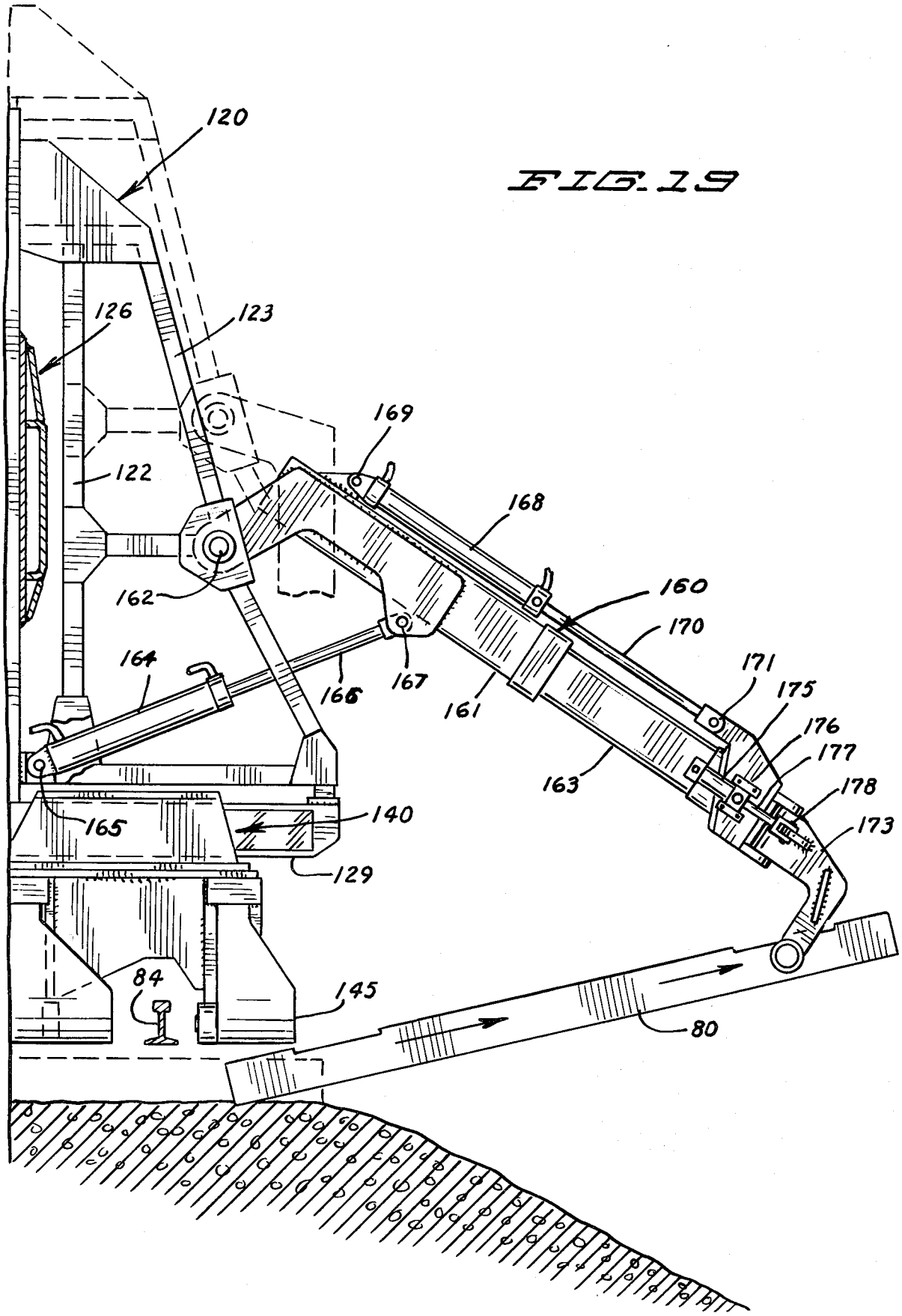
FIG. 19 is a fragmentary front elevational view of the apparatus shown in FIG. 15.

At this time in the cycle of operation, cylinders 164 and 168 may be energized to position tie clamp arms 173 and 182 over the end of a tie 80 in the relationship illustrated in FIG. 19, and hydraulic fluid is applied to cylinders 175 and 184 to complete the clamping action of tie 80 intermediate the cylindrical tie connector members 179 and 188 on tie clamp arms 173 and 182 to rotatably clamp the end of tie 80 therebetween. Further suitable energization of cylinders 164 and 168, under the guidance of the operator, serves to move the clamped end of tie 80 outwardly and upwardly to withdraw the tie from under the right-of-way system including tracks 84.

It may be noted and understood that ripper teeth 34, 35, 36, 53, 55, 145 and 155 are provided with an outer peripheral cylindrical shape that is concentric with the axes of the shafts upon which they are mounted for rotation with respect to work heads 20 and 120. This provides a shearing action on the ballast underneath tie 80 with respect to the ballast bed underneath the outer peripheral surface of the ripper teeth as they are rotated to perform their pumping action to displace the ballast from underneath and adjacent tie 80 to an adjacent crib in the track system. The leading edge of the ripper teeth may preferably be configured to present a relatively blunt cross-section, at least in the area adjacent the outer peripheral portion that travels in a position adjacent the ballast bed underneath the ripper tooth.

I claim:

1. Apparatus for removing railway ties from a track system comprising in combination;

a vertically reciprocal work head of substantial mass and including a downwardly depending surface to be placed on the top surface of a tie to be removed and downwardly depending means adapted to engage the tie to prevent lateral motion thereof; and means, including spaced apart ripper teeth operable between a retracted position above and on the side of said tie and an immersed position underneath said tie, operable to displace ballast material laterally of said tie.

2. The apparatus of claim 1 in which the ripper teeth are reciprocably operable in a direction longitudinally of the tie.

3. The apparatus of claim 1 in which the means operable to displace ballast material laterally of the tie is configured to effect said displacement by pumping action.

4. The apparatus of claim 1 in which the means operable to displace ballast material laterally of the tie is configured to effect said displacement by a shearing action.

5. The apparatus of claim 1 in which the means operable to displace ballast material laterally of the tie is configured to effect said displacement by exerting a force having insubstantial ballast compacting components.

6. A ballast displacing tool for displacing ballast material with respect to and adjacent a tie in a track system comprising, in combination;

a body portion adapted to be reciprocably immersed in the ballast underneath and adjacent a tie in a track system and ballast engaging means adapted to shearingly engage a volume of ballast material upon movement thereinto.

7. The apparatus of claim 6 in which the ballast displacing tool is adapted to be reciprocated laterally and longitudinally of a tie.

8. The method of removing railway ties from a track system, comprising the steps of:

simultaneously engaging the top and one side of a tie to be removed;

actuating spaced apart ripper teeth from a position above and on the other side of the tie to a position underneath the tie;

removing said spaced apart ripper teeth to a retracted position above and on the other side of said tie; and withdrawing said tie laterally of the rails of a track system.

9. The method of claim 8 in which ballast material is displaced from underneath the tie at longitudinally spaced apart locations.

10. The method of claim 8 in which ballast material is displaced sidewardly and longitudinally of the tie.

* * * * *